United States Patent [19]

Fausto et al.

[11] Patent Number: 4,741,639

[45] Date of Patent: May 3, 1988

[54] CARTRIDGE FOR AN INKED RIBBON WITH A RE-INKING PAD

[75] Inventors: Bruno Fausto; Walter Trimboli, both of Turin, Italy

[73] Assignee: Ing. C. Olivetti & C., S.p.A., Ivrea, Italy

[21] Appl. No.: 12,141

[22] Filed: Feb. 9, 1987

[30] Foreign Application Priority Data

Mar. 10, 1986 [IT] Italy ..... 53087/86[U]

[51] Int. Cl.[4] ..... B41J 27/12

[52] U.S. Cl. ..... 400/196.1; 400/202.4; 400/197

[58] Field of Search ..... 400/197, 202.4, 200, 400/196.1

[56] References Cited

U.S. PATENT DOCUMENTS 4,493,572 1/1985 Van Ocker et al. ..... 400/196.1

OTHER PUBLICATIONS

International Application published under The Patent Cooperation Treaty (PCT), Inventors: Sheehan et al, Title: Ribbon Cassette, Date: Nov. 1983, #WO 83/03798.

*Primary Examiner*—Charles Pearson
*Assistant Examiner*—James Lisehora
*Attorney, Agent, or Firm*—Banner, Birch, McKie & Beckett

[57] ABSTRACT

The cartridge for an inked ribbon comprises a casing having a magazine for housing the ribbon of the closed loop type and disposed in randomly distributed turns, and a pair of rollers for the feed movement of the ribbon. A re-inking pad is rotatable in the casing and an ink distribution roller co-operates with the pad for re-inking the ribbon. The distribution roller comprises a shaft having its ends projecting from the ends of the roller and housed for rotary and sliding movement in slots in the casing and the cover. The slots are rectilinear and have their axes co-planar with the shaft of the pad to permit movement of the roller away from and towards the pad. The distribution roller is held in contact against the pad by the tension applied to the ribbon by the rollers. The tension of the ribbon automatically regulates the contact pressure of the distribution roller against the re-inking pad and optimizes re-inking of the ribbon.

1 Claim, 1 Drawing Sheet

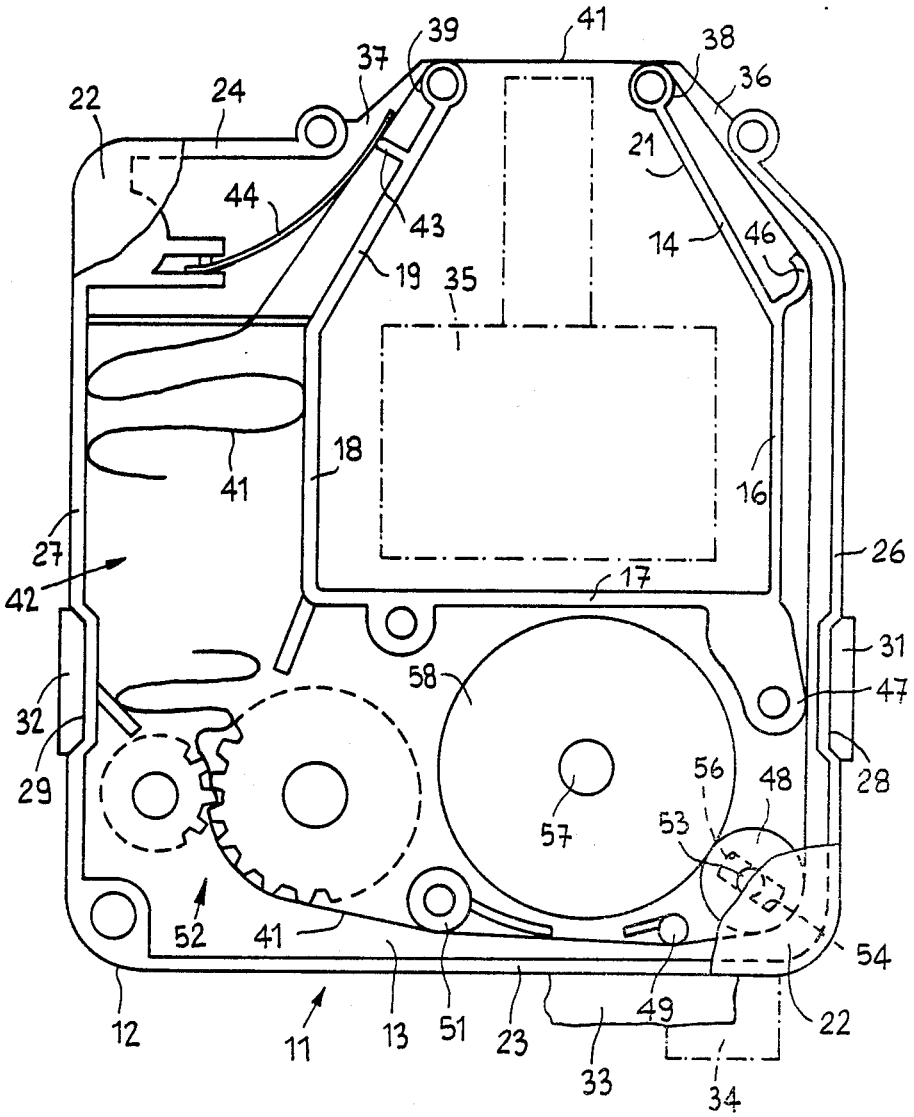
41
39
38
37
36
22
24
21
44
43
14
46
19
35
18
41
16
27
26
42
17
31
58
47
32
56
48
28
29
57
53
52
41
54
12
11
13
51
23
49
22
33
34

CARTRIDGE FOR AN INKED RIBBON WITH A RE-INKING PAD

BACKGROUND OF THE INVENTION

The present invention relates to a cartridge for an inked ribbon with a re-inking pad, comprising a casing having a magazine for housing the inked ribbon of closed loop type and disposed in randomly distributed loops, and a pair of rollers for the feed movement of the ribbon. The re-inking pad is rotatable in the casing and an ink distribution roller co-operates with the pad for re-inking the ribbon.

Various cartridges of that type are known. In a first type of cartridge, the pad is rotatable on a fixed pin and the distribution roller is mounted on an eccentric which can be manually adjusted for increasing or reducing the contact pressure of the roller against the pad. In a second type of cartridge the distribution roller is rotatable on a fixed pin while the pad is rotatable on a pin of an oscillating frame structure which is held in contact with the roller by means of a spring. In a third type of cartridge, the pad is rotatable on a fixed pipn while the distribution roller is mounted in an oscillating frame structure or bridge member which in turn is held in contact against the pad by the tension of the ribbon which is due to the feed movement thereof. All those constructions are complicated and thus relatively expensive.

SUMMARY OF THE INVENTION

The object of the present invention is to provide a cartridge for an inked ribbon with inker which is reliable, simple and which at the same time is functional, practical and inexpensive.

To this end the cartridge according to the invention comprises an ink distribution roller having a cylinder surface and a pivot pin with the two ends projecting from the cylinder surface and being housed and guided by two slots, the axis of the pivot pin is parallel to the axis of the shaft, and said two slots enable the ink distribution roller to rotate and to slide in a plane passing through the axis of the shaft.

BRIEF DESCRIPTION OF THE DRAWING

A preferred embodiment of the present invention is represented by the following description which is given by way of non-limiting example and with reference to the accompanying drawing which shows a plan view of part of the cartridge for an inked robbon with reinking pad according to the invention.

DESCRIPTION OF THE PREFERRED EMBODIMENT

Referring to the drawing, the cartridge is generally indicated by reference numeral 11 and comprises a casing 12 of a substantially parallelepipedic shape with connected rounded corners. The casing 12 comprises a bottom 13 and a series of walls 14, 16, 17, 18 and 19 for defining a space or cavity 21. The casing 12 is closed upwardly by a cover 22, a front wall 23, a rear wall 24, a right-hand side wall 26 and a left-hand side wall 27. Each side wall 26, 27 has a seat 28 and 29 co-operable with a resilient element 31, 32 of a carrier 33 of a printer 34 for positioning the cartridge 11 when it is supported with its bottom 13 on the carrier 33.

The cartridge 11 comprises two suitably shaped arms 36 and 37 which project from the right-hand side wall

26 and the rear wall 24 and which have two openings 38 and 29 respectively to permit a portion of an inked ribbon 41 to be passed and guided in front of a per se known print head 35. The inked ribbon 41 is of the closed loop type and is disposed in randomly distributed turns in a magazine 42 of the casing 12. The ribbon 41 issues from the magazine 42 and is pinched between a fixed guide 43 and a resilient blade member 44 which permits more turns from coming out of the magazine, the guide and the blade member tensioning the ribbon 41 in fornt of the head 35. The ribbon 41 then passes through the opening 39, coming out of the casing 12, to take up a position in use in front of the head 35, re-enters through the opening 38 and, after having been guided by fixed guides 46 and 47, engages an ink distribution roller 48. Subsequently, guided by fixed guides 49 and 51, the ribbon 41 is engaged with a pair of rollers generally identified by reference numeral 52 for the unidirectional feed movement thereof, and it is then passed again into the magazine 42. The forward feed movement of the ribbon 41 is effected by one of the two rollers 52 being driven by the printer 34 i per se known manner.

The distribution roller 48 is formed by a cylinder whose side surface constitutes the active part with a shaft 53 having the two ends thereof projecting from the cylinder and being capable of being housed in a slot or groove 54 in the cover 22 and in a slot or groove 56 in the bottom 13. The slots 54 and 56 are of a rectilinear configuration and are co-planar with a shaft 57 of a re-inking pad 58. The re-inking pad 58 is rotatable with its shaft 57 within the casing 12 while the distribution roller 48 is also rotatable within the casing 12 but can slide in the slots 54 and 56 in a plane which is substantially co-planar with the shaft 57.

The inked ribbon 41 engages the distribution roller 48 as described hereinbefore and, by virtue of the effect of the tension applied by the rollers 52, causes the distribution roller 48 to slide along the slots 54 and 56, holding it is contact with the reinking pad 58. During the feed movement of the ribbon 41, the tension of the ribbon 41 causes rotary movement of the roller 48. The active part thereof which is in contact with the pad 58 causes ink to be transferred from the pad 58 to the ribbon 41. In addition the tension of the ribbon 41 is such as automatically to regulate the contact pressure between distribution roller 48 and the reinking pad 58 and optimizes re-inking of the ribbon 41.

It will be apparent therefore that the distribution roller 48 is rotatable and slidable in the slots 54 and 56 and the tension of the inked ribbon 41 holds the roller 48 in contact with the re-inking pad 58 and causes rotary movement thereof, providing for automatic regulation of the contact pressure of the roller 48 with the pad 58 and optimising the re-inking effect for the ribbon 41.

What we claim is:

1. A cartridge for an inked ribbon comprising a casing having a bottom, a cover and a magazine; an inked ribbon of closed loop type housed in the magazine; wherein the inked ribbon is disposed in randomly distributed turns; a pair of rollers for the feed movement of said inked ribbon; a re-inking pad rotatably supported about an axis; an ink distribution roller movable with respect to said re-inking pad and which contacts both the re-inking pad and the inked ribbon for re-inking said inked ribbon; and means for enabling the tension of the inked ribbon to automatically regulate the contact pressure of the distribution roller against the re-inking pad to optimize re-inking of the inked ribbon, said means comprising:

the bottom of said casing and the cover of said casing each having a slot of rectilinear configuration, said slots being parallel to each other and radially disposed with respect to said axis;

the ink distribution roller comprising a cylindrical surface extending between two ends and a pivot pin extending axially of said ink distribution roller and having an end projecting from housed and guided by said slots;

said pivot pin being parallel to said axis, said ink distribution roller being rotated by said ribbon responsive to said ribbon being fed through said magazine by said pair or rollers, said slots permitting said pivot pin to slide in a plane passing through said axis to regulate the contact pressure of the distribution roller against said reinking pad.

* * * * *